US007954560B2

(12) United States Patent
Mathiszik et al.

(10) Patent No.: US 7,954,560 B2
(45) Date of Patent: Jun. 7, 2011

(54) FIBER OPTIC SENSORS IN MWD APPLICATIONS

(75) Inventors: Holger Mathiszik, Eicklingen (DE); Sebastian Csutak, Houston, TX (US); Volker Krueger, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 137 days.

(21) Appl. No.: 11/854,900

(22) Filed: Sep. 13, 2007

(65) Prior Publication Data

US 2008/0066960 A1 Mar. 20, 2008

Related U.S. Application Data

(60) Provisional application No. 60/844,791, filed on Sep. 15, 2006.

(51) Int. Cl.
*E21B 47/026* (2006.01)

(52) U.S. Cl. ..... 175/50; 175/40

(58) Field of Classification Search ..... 175/40, 175/41, 42, 45, 48, 50
See application file for complete search history.

(56) References Cited

U.S. PATENT DOCUMENTS

| | | | | |
|---|---|---|---|---|
| 5,363,095 | A | 11/1994 | Normann et al. | |
| 5,517,024 | A | 5/1996 | Mullins et al. | |
| 5,675,674 | A * | 10/1997 | Weis | 385/12 |
| 5,812,068 | A | 9/1998 | Wisler et al. | |
| 5,898,517 | A | 4/1999 | Weis | |
| 6,041,872 | A | 3/2000 | Holcomb | |
| 6,072,567 | A | 6/2000 | Sapack | |
| 6,176,323 | B1 | 1/2001 | Weirich et al. | |
| 6,206,108 | B1 | 3/2001 | MacDonald et al. | |
| 6,268,911 | B1 | 7/2001 | Tubel et al. | |
| 6,272,434 | B1 | 8/2001 | Wisler et al. | |
| 6,392,317 | B1 | 5/2002 | Hall et al. | |
| 6,510,104 | B1 | 1/2003 | Ikegami | |
| 6,588,266 | B2 | 7/2003 | Tubel et al. | |
| 6,668,465 | B2 | 12/2003 | Noureldin et al. | |
| 6,710,600 | B1 * | 3/2004 | Kopecki et al. | 324/338 |
| 6,823,602 | B2 | 11/2004 | Noureldin et al. | |
| 6,857,486 | B2 | 2/2005 | Chitwood et al. | |

(Continued)

FOREIGN PATENT DOCUMENTS

EP 0718641 B1 6/1996

(Continued)

OTHER PUBLICATIONS

Fog Based Inertial Strapdown System for Online Borehole Measurement; G. Mutter, Dr. H. Malthan, M. Hafen, & C. Noxon, LITEF GmbH; p. 681-694.

*Primary Examiner* — Shane Bomar
*Assistant Examiner* — Blake Michener
(74) *Attorney, Agent, or Firm* — Cantor Colburn LLP

(57) ABSTRACT

A wellbore drilling system utilizes optical fibers to measure parameters of interest and to communicate data. One or more electrical conductors are used to provide power to the components of the drilling system. The acquisition electronics for operating fiber optic sensors can be positioned at the surface and/or in the wellbore. In some embodiments, one optical fiber includes a plurality of sensors, each of which can measure the same or different parameters. A multiplexer multiplexes optical signals to operate such sensor configurations. Optical fiber sensors for acoustic measurements can include a cylindrical member wrapped by one or more optical fibers. The sensors can be configured as needed to provide a 3D representation of the pressure measurements.

18 Claims, 3 Drawing Sheets

U.S. PATENT DOCUMENTS

| | | | | |
|---|---|---|---|---|
| 6,868,906 | B1 | 3/2005 | Vail, III et al. | |
| 6,874,361 | B1 | 4/2005 | Meitz et al. | |
| 6,997,256 | B2 * | 2/2006 | Williams et al. | 166/250.03 |
| 7,219,729 | B2 * | 5/2007 | Bostick et al. | 166/250.01 |
| 7,245,791 | B2 * | 7/2007 | Rambow et al. | 385/12 |
| 7,277,162 | B2 * | 10/2007 | Williams | 356/32 |
| 7,597,142 | B2 * | 10/2009 | Hartog et al. | 166/250.01 |
| 2002/0066309 | A1 | 6/2002 | Tubel et al. | |
| 2003/0034177 | A1 | 2/2003 | Chitwood et al. | |
| 2003/0075361 | A1 | 4/2003 | Terry et al. | |
| 2003/0205083 | A1 | 11/2003 | Tubel | |
| 2004/0043501 | A1 | 3/2004 | Means et al. | |
| 2004/0065437 | A1 | 4/2004 | Bostwick et al. | |
| 2004/0244982 | A1 | 12/2004 | Chitwood et al. | |
| 2005/0024231 | A1 | 2/2005 | Fincher et al. | |
| 2005/0034917 | A1 | 2/2005 | Mathiszik et al. | |
| 2005/0100307 | A1 | 5/2005 | Desmone | |
| 2008/0271926 | A1 * | 11/2008 | Coronado et al. | 175/323 |

FOREIGN PATENT DOCUMENTS

| | | | |
|---|---|---|---|
| EP | 0718642 | | 6/1996 |
| WO | WO9850680 | | 11/1998 |
| WO | WO 99/00575 | | 1/1999 |
| WO | WO2004053935 | A2 | 12/2003 |
| WO | WO2004083595 | A2 | 9/2004 |
| WO | WO2004113677 | A1 | 12/2004 |

* cited by examiner

FIBER OPTIC SENSORS IN MWD APPLICATIONS

CROSS REFERENCE TO RELATED APPLICATIONS

This application takes priority from U.S. Provisional Patent Application No. 60/844,791, filed Sep. 15, 2006.

BACKGROUND OF THE INVENTION

1. Field of the Invention

This invention relates generally to wellbore drilling systems and other downhole devices that utilize fiber optics.

2. Description of the Related Art

The oilfield industry currently uses two extremes of communication within wellbores. The classification of these two extremes relate to the timing of the wellbore construction. On extreme may occur during the wellbore construction whereas the other extreme may occur after wellbore construction and during the production of hydrocarbons. During the drilling and completion phases, communication is accomplished using a form of mud pulse telemetry commonly utilized within measurement while drilling (MWD) systems. Alternative methods of telemetry, such as low frequency electromagnetic and acoustics, have been investigated and found to be of limited or specialized use. In general MWD telemetry is bound by the speed of sound and the viscous properties in the drilling fluid. Thus, data rates for mud pulse telemetry seldom exceed 10 bits per second.

An increase in the number and complexity of downhole sensors in MWD systems has increased the need for higher data rates for the telemetry link. Also, the introduction of rotary closed loop steering systems has increased the need for bi-directional telemetry from the top to the bottom of the well.

Industry efforts to develop high data rate telemetry have included methods to incorporate fiber optic or wire technology into the drillstring, transmitting acoustic signals through the drill string, and transmitting electromagnetic signals through the earth surrounding the drill string. U.S. Pat. No. 4,095,865 to Denison, et al, describes sections of drill pipe, pre-wired with an electrical conductor, however each section of pipe is specially fabricated and difficult and expensive to maintain. Acoustic systems suffer from attenuation and filtering effects caused by reflections at each drill joint connection. Attempts have been made to predict the filtering effects, such as that described in U.S. Pat. No. 5,477,505 to Drumheller. In most such techniques, signal boosters or repeaters are required on the order of every 1000 feet. Thus, to date, the only practical and commercial method of MWD telemetry is modulation of mud flow and pressure, which has a relatively slow data rate.

Once a well is drilled and completed, special sensors and control devices are commonly installed to assist in operation of the well. These devices historically have been individually controlled or monitored by dedicated lines. These controls were initially hydraulically operated valves (e.g., subsurface safety valves) or were sliding sleeves operated by shifting tools physically run in on a special wireline to shift the sleeve, as needed.

The next evolution in downhole sensing and control was moving from hydraulic to electric cabling permanently mounted in the wellbore and communicating back to surface control and reporting units. Initially, these control lines provided both power and data/command between downhole and the surface. With advances in sensor technology, the ability to multiplex along wires now allows multiple sensors to be used along a single wire path. The industry has begun to use fiber optic transmission lines in place of traditional electric wire for data communication.

While conventional system utilizing fiber optics provide some additional functionality versus prior wellbore communication and measurement systems, advances in wellbore drilling technologies have to date outpaced the benefits provided by such conventional fiber optic arrangements. The present invention is directed to addressing one or more of the above stated drawbacks of conventional fiber optic systems used in wellbore applications.

SUMMARY OF THE INVENTION

In aspects, the present invention provides a wellbore drilling system that utilizes fiber optic sensors within a fiber optic data communication system. In one embodiment, the system includes a wellbore drilling assembly having one or more fiber optic sensors positioned along the drill tubing and/or at the bottomhole assembly (BHA). The data signals provided by these fiber optic sensors are conveyed along one or more optical fiber positioned in the BHA and/or along the drill tubing, which may be jointed drill pipe or coiled tubing. The optical fibers provide the primary conduit for conveying data and command signals along, to and from the BHA. Additionally, one or more electrical conductors positioned along at least a section of the drill string provide power to the components of the BHA. In some embodiments, one optical fiber includes a plurality of sensors, each of which can measure the same or different parameters. The acquisition electronics for operating the fiber optic sensors, such as a light source and a detector, can be positioned at the surface and/or in the wellbore. In some embodiments, a single light source may be used to operate two or more fiber optic sensors configured to detect different parameters of interest. A multiplexer multiplexes optical signals to operate those and other sensor configurations.

In another aspect, the present invention provides an acoustic sensor used to measure acoustic energy in the borehole. Exemplary applications include vertical seismic profiling and acoustic position logging. An exemplary device for measuring acoustical energy in a wellbore includes a mandrel or cylindrical member that is wrapped by one or more optical fibers. The optical fiber(s) can include at least one and perhaps hundreds of pressure sensors. In arrangements where the fibers are helically wrapped around the mandrel, these pressure sensors will be arrayed circumferentially around the body. Other arrangements can include longitudinally spaced apart rings of sensors. Thus, the sensors can be longitudinally and/or circumferentially spaced apart. During operation, the pressure pulses within the surrounding wellbore fluid will be detected by the sensors to provide a 3D representation of the pressure measurements.

The utilization of fiber optics within the architecture of the data communication and measurement systems in the drill string can simplify the design of the bottomhole assembly (BHA) and increase its robustness. For instance, the utilization of fiber optic sensors can reduce the complexity of the data acquisition systems since the same physical principles can be used to measure different parameters of interest. Accordingly, only one or a few support and acquisition systems are needed to support a suite of different sensors; e.g., accelerometers, strain gages, pressure sensors, temperature sensors, etc.

It should be understood that examples of the more important features of the invention have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DETAILED DESCRIPTION OF THE PREFERRED EMBODIMENT

Figure 1:
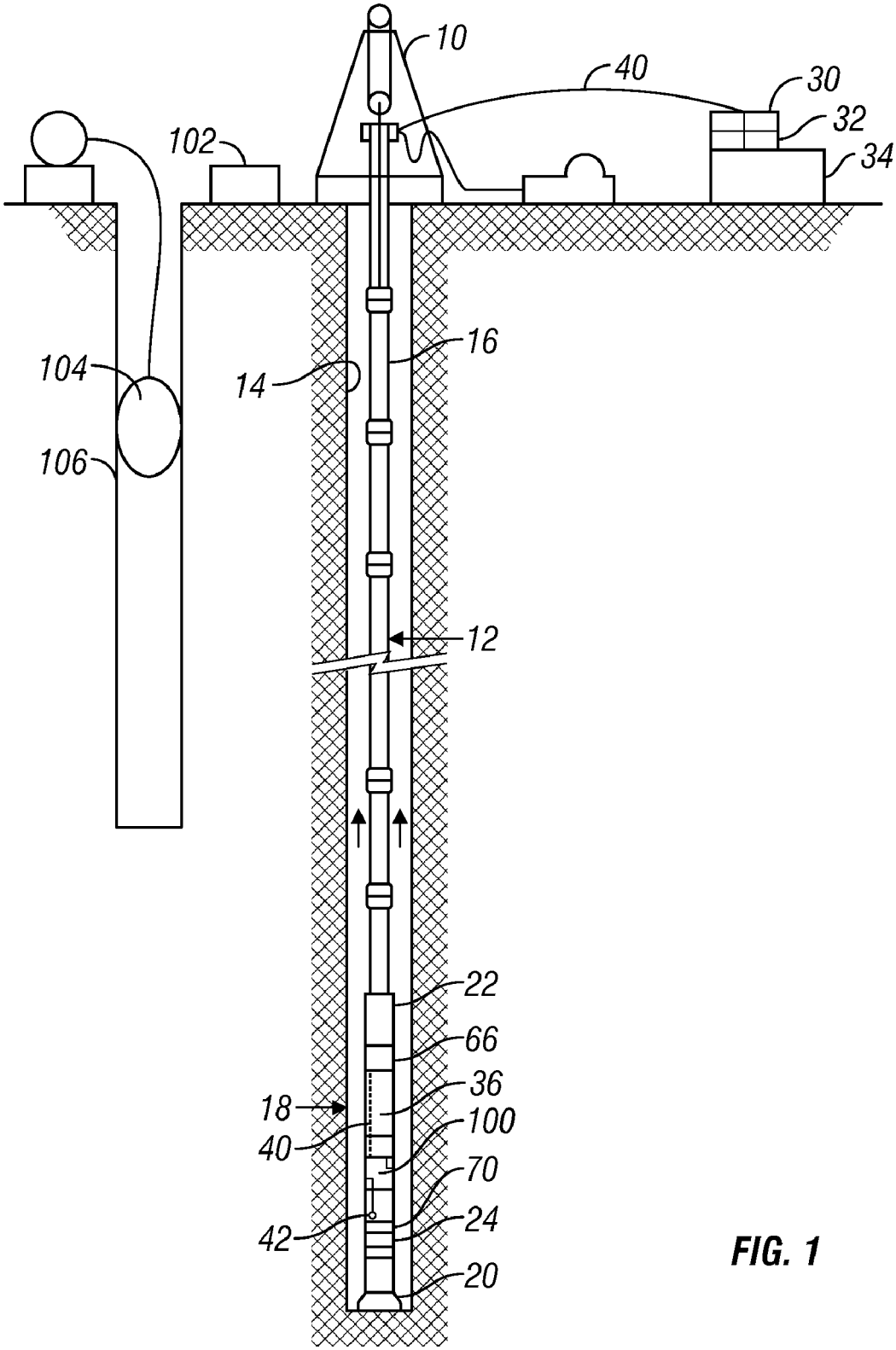
FIG. 1 is a schematic drawing of a drilling system utilizing fiber optic sensors and fiber optic communication devices according to an embodiment of the present invention.

The present invention relates to devices and methods that measure parameters of interest utilizing fiber optic sensors and that provide data communication via optical fibers for wellbore drilling systems. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

Referring initially to FIG. 1, there is shown as an example and not as a limitation, a drilling operation has a conventional derrick 10 for supporting a drill string 12 in a borehole 14, also called a wellbore. The drill string 12 includes multiple sections of drill pipe 16 connected together by threaded connections. In other embodiments, the drill string 12 can include other conveyance devices such as coiled tubing. Further, the drill pipe 16 can include optical fibers or cables. Such optical conductors can be positioned inside or outside of the drill string 12. Additionally, some embodiments can utilize "wired" pipe, i.e., pipe with embedded optical conductors and other types of conductors such a metal wires that conduct electrical signals. A bottomhole assembly 18 is attached to the bottom end of the drill string 12 and has a drill bit 20 attached to a bottom end thereof. The drill bit 20 is rotated to drill through the earth formations. The bottom hole assembly 18 comprises multiple sections of drill collars 22 and may have a measurement while drilling (MWD) system 24 attached therein. Measurement while drilling and/or logging while drilling (LWD) systems are well known in the art. Such systems commonly measure a number of parameters of interest regarding the drilling operation, the formation surrounding the borehole 14 and the position and direction of the drill bit 20 in the borehole 14. Such systems may include a downhole processor 36 to provide open or closed loop control, in conjunction with a steerable system (not shown), of the borehole 14 path toward a predetermined target in the subterranean formations.

As will described in greater detail below, embodiments of drilling systems made in accordance with the present invention include one or more fiber optic sensors and one or more fiber optic cables that provide high bandwidth data communication across the drill string 12. Embodiments of the present invention also include a distributed measurement and communication network that provides the ability to determine conditions along the drill string 16 and the BHA 18 during drilling operations.

Referring still to FIG. 1, in one arrangement, the drill string 12 includes a plurality of fiber optic sensors, a representative fiber optic sensor being labeled with numeral 42, that are distributed along the BHA 18 and/or the drill string 16. The drill string 12 includes one or more optical fibers 40 that optically connect the fiber optic sensors 42 to the surface. Acquisition electronics for operating the sensors 42 include a light source 30 and detector 32 positioned at the surface. The detector 32 can be an inferometer or other suitable device. The acquisition electronics are optically coupled to the fibers 40 in the drill string 16. Alternatively, the light source 30 and/or the detector 32 can be placed downhole. In a conventional fashion, the light source 30 and the detector 32 cooperate to transmit light energy to the sensors 42 and to receive the reflected light energy from the sensors 42. A data acquisition and processing unit 34 (also referred to herein as a "processor" or "controller") may be positioned at the surface to control the operation of the sensors 42, to process sensor signals and data, and to communicate with other equipment and devices, including devices in the wellbores or at the surface. Alternatively or in conjunction with the surface processor 34, the downhole processor 36 may be used to provide such control functions.

Figure 2:
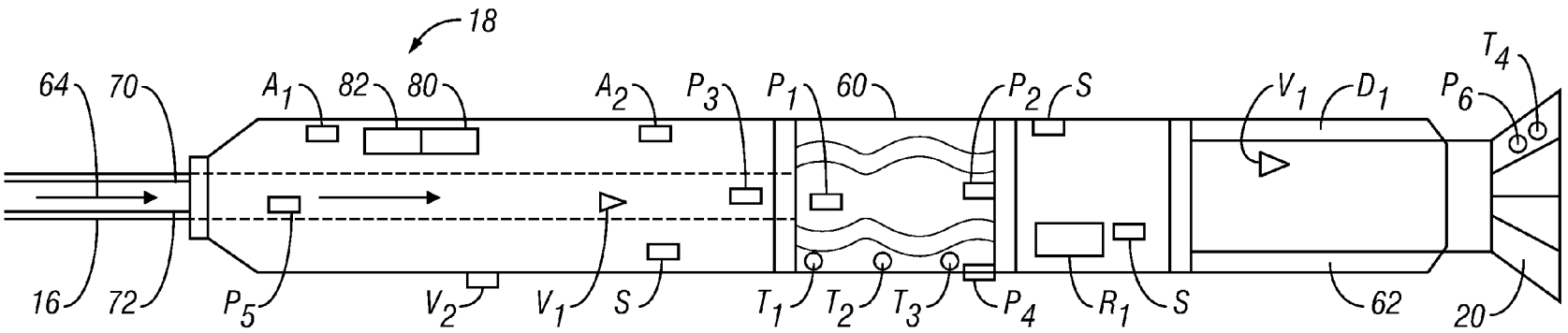
FIG. 2 shows a schematic view of a BHA utilizing fiber optic architecture in accordance with one embodiment of the present invention.

Referring now to FIG. 2, there is shown an exemplary bottomhole assembly 18 provided with optical sensors and a fiber optic cable communication system. The bottomhole assembly 18 is conveyed by the drill string 16 such as a drill pipe or a coiled-tubing. A mud motor 60 rotates the drill bit 20. A bearing assembly 62 coupled to the drill bit 20 provides lateral and axial support to the drill bit 20. Drilling fluid 64 passes through the system 18 and drives the mud motor 60, which in turn rotates the drill bit 20.

As described below, a variety of fiber optic sensors are placed in the BHA 18, drill bit 20 and/or the drill string 16. These sensors can be configured to determine formation parameters, measure acoustic energy, determined fluid properties, measure dynamic drillstring conditions, and monitor the various components of the drill string including the condition of the drill bit, mud motor, bearing assembly and any other component part of the system. In embodiments, each fiber optic sensor can be configured to operate in more than one mode to provide a number of different measurements. An optical fiber may include a plurality of sensors distributed along its length.

The following is a non-limiting description of exemplary sensors that could be based on fiber optic structure. Sensors T1-T3 monitor the temperature of the elastomeric stator of the mud motor 60. The sensors P1-P5 monitor differential pressure across the mud motor, pressure of the annulus and the pressure of the fluid flowing through the BHA 18. Flow sensors V1 provide measurements for the fluid flow through the BHA 18 and the wellbore. Vibration and displacement sensors V2 may monitor the vibration of the BHA 18, the lateral and axial displacement of the drill shaft, and/or the lateral and axial displacement of the BHA 18. Fiber optic sensor R1 may be used to detect radiation. Acoustic sensors A1-A2 may be placed in the BHA 18 for determining the acoustic properties of the formation. Temperature and pressure sensors T4 and P6 may be placed in the drill bit 20 for monitoring the condition of the drill bit 20. Additionally sensors, generally denoted herein as S may be used to provide measurements for resistivity, electric field, magnetic field and other desired measurements. Of course, the BHA 18 can include a mix of fiber optic sensors and non-fiber optic sensors.

A single light source, such as the light source 30 (FIG. 1), may be utilized for all fiber optic sensors in the wellbore 12. Since the same sensor may make different types of measurements, the data acquisition unit 36 (FIG. 1) can be programmed to multiplex the measurement(s). Also different types of sensors may be multiplexed as required. Suitable multiplexing techniques include but are not limited to, time division multiplexing and wave division multiplexing. Multiplexing techniques are know in the art and are thus not described in detail herein. Alternatively, multiple light sources and data acquisition units may be used downhole, at the surface or in combination. Additionally, as shown, in certain embodiments, a light source 80 and a data acquisition unit 82 may be positioned in the BHA 18.

In one embodiment, the BHA 18 uses electrical conductors for the power distribution system and uses fiber optics in the data communication architecture. For example, BHA 18 can contain one or more electrical conductors 70 that convey power to various BHA 18 components from surface and/or downhole sources. Additionally, the BHA 18 contains optical fibers or cables 72 for transmitting data signals along the length of BHA 18 and/or to the surface. The optical fibers 72 can be used to transmit sensor measurements as well as transmit control signals. Exemplary control signals could include commands to activate or deactivate BHA 18 devices. Thus, in one arrangement, the optical fibers 72 are used exclusively for data communication and the electrical conductors 70 used for electrical power distribution. In other embodiments, the electrical conductors 70 could be used as a secondary or redundant conduct for signal and/or data transfer. Communication with the surface, however, need not rely solely on optical wires. Supplemental data transfer can be provided by electromagnetic, pressure pulse, acoustic, and/or other suitable techniques along the drill drill string 16.

Referring now to FIG. 1, there is shown an acoustic tool 100 for measuring acoustic energy in fluids such as wellbore fluids. The acoustic tool 100 utilizes optical fibers to measure pressure waves associated with acoustic energy imparted into a formation of interest. Exemplary non-limiting applications for the acoustic toll 100 include vertical seismic profiling and acoustic position logging.

As is known, vertical seismic profiling (VSP) can be useful for developing geological information for directional drilling and other activities. Vertical seismic profiling or "VSP" is a well known technique to obtain data on the characteristics of lithological formations. In some conventional VSP operations, one or more seismic sources 102 are positioned near the borehole at the surface. For cross-well applications, a source 104 can be positioned in an offset well 106. For acoustic position logging and other like applications, a source 66 can be positioned in the wellbore 14 itself. For instance, the source can be attached at a selected location along the drill string 16 or positioned in the BHA 18. Also in certain embodiments, a combination of sources in these separate locations can also be used.

Referring still to FIG. 1, the acoustic tool 100 can include a plurality of axially spaced apart receivers, which are discussed in greater detail below. An exemplary acoustic tool can include a plurality of receivers each grouped into axially spaced apart stations. The acoustic measurements taken by the receivers can be controlled and processed with a downhole data acquisition system 70. During operation, a source, such as the source 66, is fired to emit an acoustic energy burst at an optimum frequency into the formation around the borehole. The receivers then measure the wavefront as the energy passes along the borehole wall adjacent to the acoustic tool 100.

Figure 3:
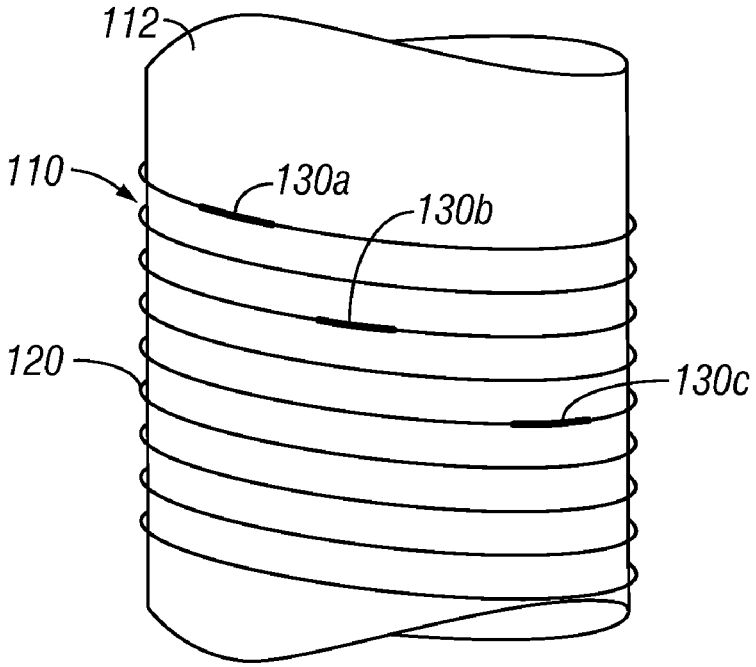
FIG. 3 shows a side view of an acoustic energy sensing device made in accordance with one embodiment of the present invention.

Referring now to FIG. 3, one exemplary receiver 110 utilizes optical fibers to measure the pressure waves generated by one or more of these sources. In one embodiment, a mandrel or body 112 is wrapped by one or more optical wires 120. The mandrel can be a drill collar or other suitable structure. For example, a single wire 120 can include a plurality of pressure sensors formed using bragg gratings, representative pressure sensors being labeled 130*a,b,c*. While only three sensors have been labeled, it should be understood that tens or hundreds of sensors could be formed in a single optical wire. Moreover, it should be appreciated the wrapping the optical wire around the body 112 provides an array-like geometry wherein the pressure sensors 130*a,b,c* are positioned in different locations both circumferentially and axially. Due to this arrangement, high resolution 3D acoustic measurements can be made by acquisition electronics 70 (FIG. 1) receiving pressure data from each of the sensors 130*a,b,c*. In other arrangements, sensors such as accelerometers or other such motion sensing devices can be positioned inside the body 112.

Figure 4:
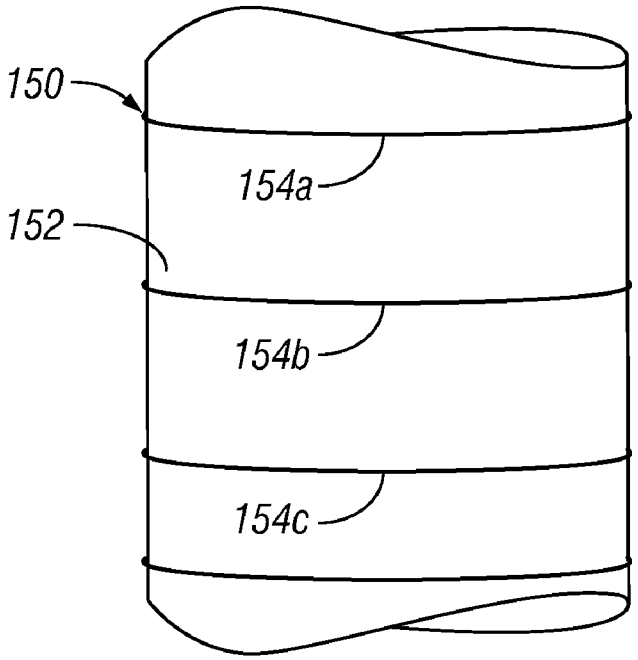
FIG. 4 shows a side view of another acoustic energy sensing device made in accordance with one embodiment of the present invention.

Referring now to FIG. 4, there is shown another receiver 150 for measuring acoustic energy in a wellbore fluid during vertical seismic profiling. Like the FIG. 3 embodiment, the receiver 150 utilizes optical fibers to measure the pressure waves in the wellbore and includes a mandrel or body 152 wrapped by one or more optical fibers 154*a-c*. The fibers 154*a-c* are wrapped circumferentially around the body 152 and are spaced-apart longitudinally relative to one another.

It should be understood that the FIGS. 3 and 4 arrangements are merely illustrative of how optical fibers can be arranged on the mandrel or body to measure parameters of interest such as pressure. For instance, the fibers of FIG. 3 can run axially rather than circumferentially along the outside of the pipe. Moreover, as noted earlier, the fibers or other sensors can be positioned inside the body 152. It should therefore be appreciated that the fibers can be configured as needed to obtain pressure data or another selected parameter of interest in any desired direction(s).

The foregoing description is directed to particular embodiments of the present invention for the purpose of illustration and explanation. It will be apparent, however, to one skilled in the art that many modifications and changes to the embodiment set forth above are possible without departing from the scope of the invention. It is intended that the following claims be interpreted to embrace all such modifications and changes.

What is claimed is:

1. A system for drilling a wellbore, comprising:

a drill string configured to be conveyed into the wellbore;

a plurality of fiber optic sensors forming an array along a bottomhole assembly of the drill string, at least one of the fiber optic sensors configured to obtain acoustic measurements related to a selected parameter of interest;

at least one optical fiber wrapped around an outer surface of the bottomhole assembly and coupled to the plurality of fiber optic sensors, the at least one optical fiber being configured for data communication;

a processor configured to process the acoustic measurements related to the selected parameter of interest to provide a three-dimensional representation of the selected parameter of interest; and at least one power conductor positioned along at least a section of the drill string configured to provide power to one or more selected devices on the drill string.

2. The system of claim 1 further comprising a light source and a detector coupled to the at least one optical fiber.

3. The system of claim 2 wherein the light source and the detector are positioned at a surface location.

4. The system of claim 1 wherein the plurality of sensors are further configured to measure an additional parameter of interest selected from one of: (i) temperature, (ii) strain, and (iii) acceleration.

5. The system of claim 4 further comprising a single light source for obtaining measurements of the selected parameter of interest and the additional parameter of interest.

6. The system of claim 1 further comprising a multiplexer configured to multiplex optical signals carried by the at least one optical fiber.

7. The system of claim 1 wherein the at least one fiber optic sensor is positioned on an outer surface of the drill string.

8. The system of claim 1 wherein the selected parameter of interest is pressure.

9. The system of claim 1 further comprising an acoustic source along the drill string configured to emit acoustic energy into the wellbore.

10. An apparatus for use in drilling a wellbore, comprising:

a bottomhole assembly connected to a conveyance device configured to be conveyed into the wellbore;

at least one optical fiber wrapped around an outer surface of the bottomhole assembly;

a plurality of fiber optic sensors formed along the at least one optical fiber forming an array along the outer surface of the bottomhole assembly, wherein at least one of the fiber optic sensors is configured to obtain acoustic measurements related to a selected parameter of interest;

a processor configured to process the acoustic measurements related to the selected parameter of interest to provide a three-dimensional representation of the selected parameter of interest; and at least one power conductor positioned along the conveyance device configured to provide power to one or more selected devices on the conveyance device to drill the wellbore.

11. The apparatus of claim 10 wherein the selected parameter of interest is pressure.

12. The apparatus of claim 10 wherein the plurality of sensors are arrayed at least one of (i) circumferentially around the body, (ii) spaced-apart longitudinally on the body.

13. The apparatus of claim 10 wherein the plurality of sensors are longitudinally and circumferentially spaced apart.

14. A method for drilling a wellbore, comprising:

conveying a drill string having a bottomhole assembly into the wellbore;

obtaining at least one acoustic measurement of a parameter of interest using at least one of a plurality of fiber optic sensors forming an array along the bottomhole assembly;

transferring data from the at least one fiber optic sensor using at least one optical fiber coupled to the at least one fiber optic sensor and wrapped around an outer surface of a section of the bottomhole assembly;

processing the at least one acoustic measurement to provide a three-dimensional representation of the at least one parameter of interest; and conveying power along a section of the drill string using at least one power conductor positioned along at least a section of the drill string.

15. The method of claim 14 further comprising operatively coupling a light source and a detector to the at least one optical fiber, wherein the light source and the detector are positioned at a surface location.

16. The method of claim 14 further comprising measuring a plurality of parameters of interest using the at least one fiber optic sensor.

17. The method of claim 14 further comprising emitting acoustic energy into the wellbore.

18. The method of claim 17 further comprising detecting the emitted acoustic energy using the at least one fiber optic sensor.

* * * * *